United States Patent [19]

Kernodle, Sr.

[11] Patent Number: 4,687,108

[45] Date of Patent: Aug. 18, 1987

[54] FLANGED ITEM HOLDER

[76] Inventor: James W. Kernodle, Sr., Rte. 2, Box 542, Durham, N.C. 27705

[21] Appl. No.: 891,130

[22] Filed: Jul. 31, 1986

[51] Int. Cl.[4] ..... A47F 7/00

[52] U.S. Cl. ..... 211/13; 211/74

[58] Field of Search ..... 211/13, 74, 41, 94, 211/89, 71, 69.2, 70.6, 75, 162, 126, 128, 133; 248/346, 346.1

[56] References Cited

U.S. PATENT DOCUMENTS

| | | | |
|---|---|---|---|
| 1,925,540 | 9/1933 | Neuschotz | 248/311.3 |
| 2,400,832 | 5/1946 | Kress | 211/74 X |
| 3,233,804 | 2/1966 | Dahm | 211/74 X |
| 3,266,533 | 8/1966 | McHale | 211/74 X |
| 4,008,810 | 2/1977 | Merz | 211/74 X |
| 4,378,889 | 4/1983 | Lebowitz | 211/74 X |

*Primary Examiner*—Robert W. Gibson, Jr.
*Assistant Examiner*—Sarah A. Lechok Eley
*Attorney, Agent, or Firm*—Lynn E. Barber; Paul Overhauser

[57] ABSTRACT

Base unit and receptacle for holding various household items. The base unit is comprised of a surface with channels having inwardly projecting flanges. Receptacles have a flange capable of being inserted into the channel in the base. The flange on each receptacle is rectangular in shape, preventing the receptacle from being rotated when in the base channel. The invention is particularly useful for persons who have difficulty unscrewing lids on bottles due to limited use of their hands.

6 Claims, 4 Drawing Figures

FLANGED ITEM HOLDER

FIELD OF THE INVENTION

The present invention relates to a device for supporting small bottles, cosmetics and writing instruments, and more particularly pertains to a device for supporting such items having screw-on tops and lids. The device is particularly useful for handicapped persons or persons having use of only one hand, who find it difficult to remove screw tops.

BACKGROUND OF THE INVENTION

Many small bottles and jars contain screw-on tops to seal the contents in the bottle. Often, persons with limited use of their hands or arms encounter difficulty in removing these screw-on tops. In addition, such bottles are often prone to being accidently tipped over, spilling the contents. Furthermore, persons such as artists who use a wide variety of bottles at once often find it difficult to keep the bottles neatly organized, resulting in a cluttered and messy work area. The present invention provides a device for holding small bottles stationary, so that the base of the bottle need not be held in order to unscrew the top. The device also prevents the bottles from being tipped over, and organizes the bottles as well.

OBJECTS OF THE INVENTION

One object of the invention is to provide a bottle—bottle holder combination which can be used to keep the base of a bottle stationary so that the lid of the bottle can be unscrewed using only one hand.

Another object of the invention is to provide a device which can hold several bottles at once, to keep them from tipping over and allow them to be neatly organized.

Another object of the invention is to provide a base which can be used to hold bottles, pens and other objects having standard sized flanges, so different objects may be placed in the base interchangeably.

Another object of the invention is to provide a base which can easily be secured to desktops or countertops.

Another object of the invention is to provide a device which can be inexpensively constructed.

Still other objects and advantages of the invention will become apparent to those of skill in the art after reading the following description of a preferred embodiment.

SUMMARY OF THE INVENTION

The invention consists of a combination of a bottle or container having a flanged bottom, and a base having several sets of channels each of which is capable of receiving the flange of a bottle or other container. The base also contains a means for securement to a flat surface, such as a tabletop or countertop. When a bottle or other container is slid into the base, it is held in place, preventing it from tipping over. In addition, the base prevents the bottle from rotating. Therefore, a screw-top on the bottle can be tightly screwed or unscrewed by turning only the top, and it is unnecessary to separately hold the bottom of the bottle.

DETAILED DESCRIPTION OF THE DRAWINGS

Figure 1:
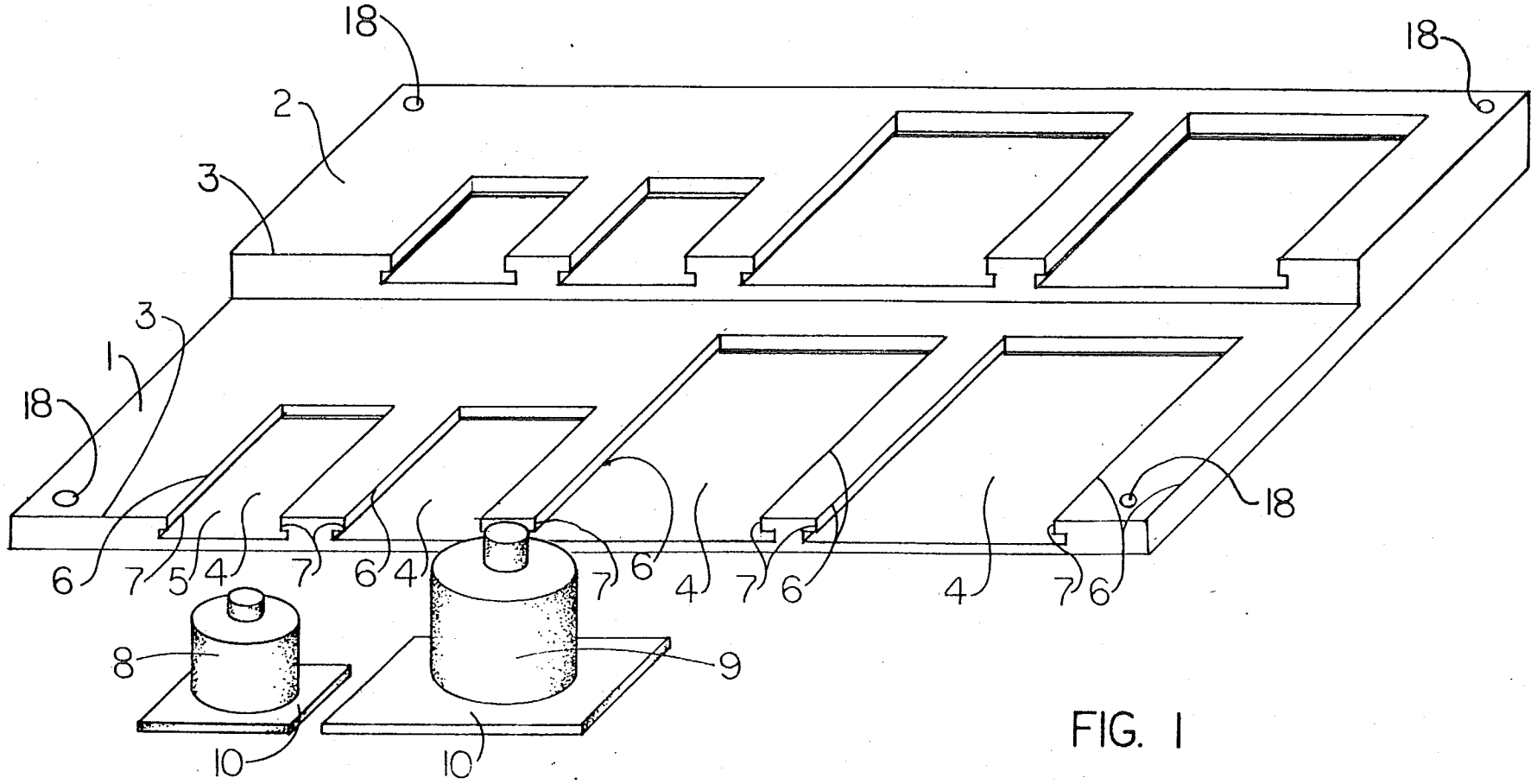
FIG. 1 is a perspective view of one embodiment of the invention, which discloses a two-layered base and two flanged bottles.

FIG. 1 is a perspective view of one embodiment of the invention, which discloses a two-layered base and two flanged bottles. The base is comprised of a lower portion 1 and an upper portion 2. It may be appreciated that additional levels may be added to the base in order to accommodate additional bottles. Each level has a front edge 3, into which a plurality of channels 4 project. The channels are rectangular in shape and have one edge 5 that is common with front edge 3. Each channel has two opposite sides 6 which are perpendicular to front edge 3. Opposite sides 6 include an inwardly projecting flange 7 at their edges. As indicated, channels 4 may be of differing sizes as long as the overall rectangular shape is maintained.

The channels are designed to accommodate items having rectangular flanges, for example bottles 8 and 9. Each bottle has flange 10 at its base of a width and thickness allowing it to be slid into a channel 4. As long as flange 10 fits securely into channel 4, the bottle itself may be of any size or shape. The channels themselves may be of varying sizes to accommodate differently sized containers.

It can be appreciated that once a bottle with a screw-on top is inserted into base 1, that the bottle may not be rotated with respect to the base due to fit of the bottle flange in the channel. However, such a rotating action on the bottle may cause the entire base to rotate if the base itself is not heavy or is unsecured to another surface. Such securement may be accomplished by several means. Base 1 may be screwed to a surface through screwholes 18. Alternatively, the bottom of base 1 may be made with an adhesive or magnetic base to provide securement to an appropriate surface.

Figure 2:
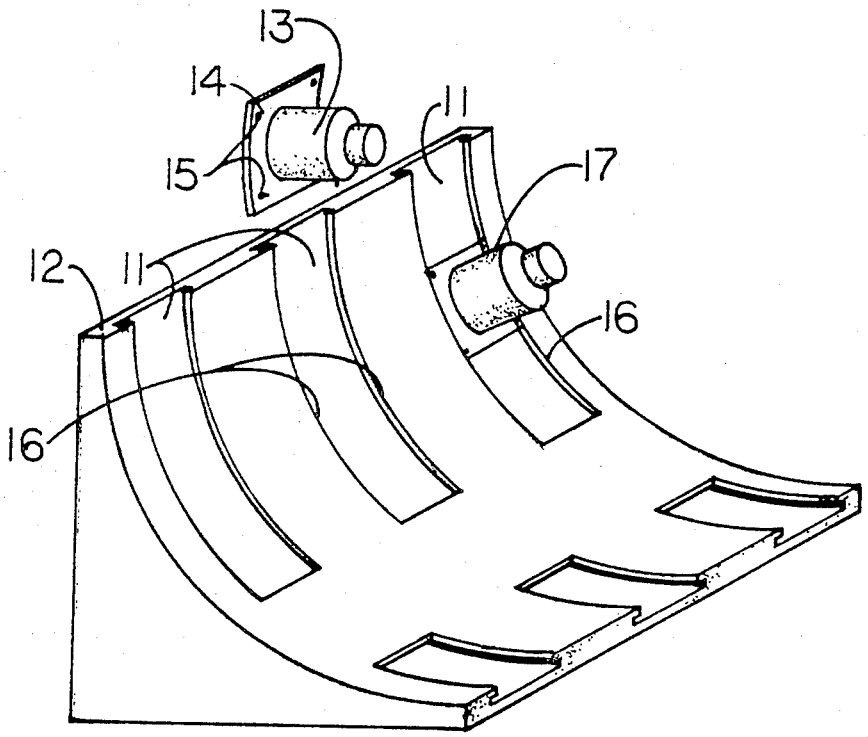
FIG. 2 is a perspective view of another embodiment of the invention, wherein the top of the base is curved so bottles may be positioned at different vertical angles in the base.

FIG. 2 is a perspective view of another embodiment of the invention, wherein the top of the base is curved so bottles may be positioned at different vertical angles in the base. In this embodiment, one set of base channels 11 open on edge 12. Bottle 13 includes flange 14 which securely fits into channels 11. Flange 14 also contains indentations 15. The inwardly projecting channels 16 of channels 11 contain knobs (or projections) (not shown) the same size of indentations 15. These indentations are spaced so that they match the indentations on flange 15, which allow the bottle to be held in place above the bottom of the channel, as depicted by bottle 17. A series of these matching projections may be placed at various locations along the flanges 16 of channel 17, so that a bottle may be situated at different vertical angles. This configuration increases the accessibility of the bottles for certain applications.

Figure 3:
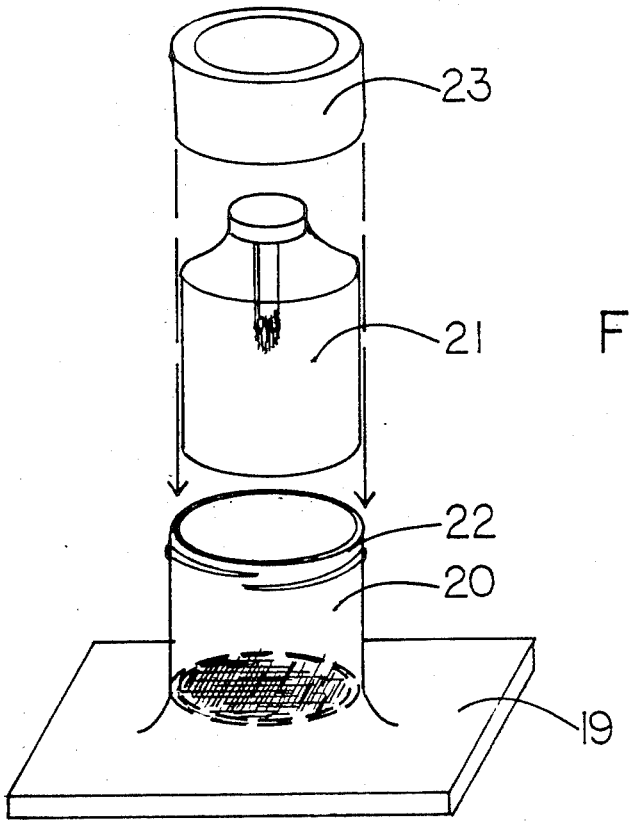
FIG. 3 is a perspective view of a flanged holder into which a standard unflanged bottle may be inserted for use with the base.

FIG. 3 is a perspective view of a flanged holder into which a standard unflanged bottle may be inserted for use with the base. One disadvantage of the present invention is that bottles with flanges as described above are not in widespread commercial use. Therefore, it may be necessary to use a flanged bottle holder to take full advantage of the features of the invention. Such a holder may be comprised of a flanged base 19, connected to a bottle receptacle 20. A standardly configured bottle 21 may be placed in receptacle 20. External threads 22 on receptacle 20 allow holder top 23 to hold bottle 21 in place. The top of bottle 21 projects through a hole in the top of the holder top 23. In order to prevent bottle 21 from rotating in receptacle 20 it may be desirable to deposit an adhesive in the interior bottom of receptacle 20.

Figure 4:
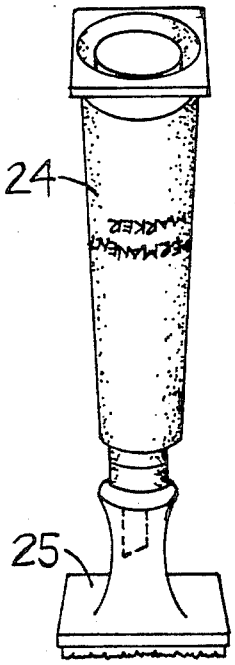
FIG. 4 is a perspective view of a felt marker having a cap which may be used with the base of the invention.

FIG. 4 is a perspective view of a felt marker having a cap which may be used with the base of the invention. In addition to holding bottles and jars, the invention may also be used to hold other items such as pens and markers. For example, marker 24 has a flanged cap 25, which may be fitted into a channel as described above. From this design, it may be appreciated that the present invention may be used with any item having a flange, and many household items may be constructed with a flange for use with the invention. This includes such items as lipstick and other cosmetics, and pen and pencil holders for example.

I claim:

1. A device for holding bottles and office supplies, comprising in combination:

(A) a base having
- (1) a curved top surface having an edge,
- (2) means for securement of said base to a flat surface,
- (3) a plurality of channels in said top surface, each channel
  - (a) being rectangular in shape,
  - (b) having an insertion edge being congruous with an edge of said top surface, and
  - (c) having two side edges perpendicular and abutting said insertion edge, each side edge having flanges flush with the top surface which project inward towards said channel; and (B) at least one receptacle having a flat bottom with outwardly projecting rectangular flanges capable of sliding into the channel of said base, said outwardly projecting rectangular flanges of the receptacle having indentations on the flange corners, and the flange of each side edge having two knobs projecting downward into said channel, so that the knobs fit into the indentations of the receptacle flanges when the receptacle is slid into said channel.

2. The device recited in claim 1 wherein said receptacle is capable of receiving the writing tip of a writing utensil.

3. A device for holding bottles and office supplies, comprising in combination:

(A) a base having
- (1) a top surface having an edge,
- (2) means for securement of said base to a flat surface,
- (3) a plurality of channels in said top surface, each channel
  - (a) being rectangular in shape,
  - (b) having an insertion edge being congruous with an edge of said top surface, and
  - (c) having two side edges perpendicular and abutting said insertion edge, each side edge having flanges flush with the top surface which project inward towards said channel; and (B) at least one receptacle having a flat bottom with outwardly projecting rectangular flanges capable of sliding into the channel of said base; said receptacle including a cylindrically shaped container extending upwardly from said rectangular flange, said container being capable of receiving a jar or bottle, and including exterior threads disposed on the top of said cylindrically shaped container; and a container top having an axial aperture and interior threads capable of being screwed onto the top of said cylindrically shaped container so that the top of a bottle or jar placed in said container projects from the aperture of the container top.

4. The device recited in claim 3, wherein the top surface is comprised of two parallel levels, each of which has a plurality of channels as described in claim 3.

5. A device for holding bottles and office supplies, comprising in combination:

(A) a base having
- (1) a top surface having a front and a back,
- (2) means for securement of said base to a flat surface,
- (3) a plurality of channels in said top surface, each channel
  - (a) being rectangular in shape,
  - (b) having an insertion edge being congruous with an edge of said top surface, and
  - (c) having two side edges perpendicular and abutting said insertion edge, each side edge having flanges flush with the top surface which project inward towards said channel; and (B) at least one receptacle having a flat bottom with outwardly projecting rectangular flanges capable of sliding into the channel of said base, said outwardly projecting rectangular flanges of the receptacle having indentations on the flanges, and the flange of each side edge having two knobs projecting downward into said channel, so that the knobs fit into the indentations of the receptacle flanges when the receptacle is slid into said channel.

6. The device recited in claim 5, wherein the top surface is curved at the back and is flat at the front and at least one of the channels in the top surface has an insertion edge at the front of the top surface and at least one of the channels in the top surface has an insertion edge at the back of the top surface.

* * * * *